US007402090B2

(12) United States Patent
Okuyama

(10) Patent No.: US 7,402,090 B2
(45) Date of Patent: Jul. 22, 2008

(54) WATERCRAFT

(75) Inventor: Takashi Okuyama, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 57 days.

(21) Appl. No.: 11/529,131

(22) Filed: Sep. 28, 2006

(65) Prior Publication Data

US 2007/0082564 A1 Apr. 12, 2007

(30) Foreign Application Priority Data

Oct. 7, 2005 (JP) ..... 2005-294352

(51) Int. Cl.
*B63H 21/21* (2006.01)

(52) U.S. Cl. ..... 440/84; 440/86; 440/87

(58) Field of Classification Search ..... 440/1, 440/84, 86, 87; 74/480 B; 701/21, 36, 37
See application file for complete search history.

(56) References Cited

U.S. PATENT DOCUMENTS 3,958,524 A * 5/1976 Cantley et al. ..... 74/480 B
4,836,809 A * 6/1989 Pelligrino ..... 440/84
4,920,819 A * 5/1990 Uchida et al. ..... 74/480 B
5,056,379 A * 10/1991 den Ouden ..... 74/480 B
5,080,619 A * 1/1992 Uchida et al. ..... 440/84
5,094,122 A * 3/1992 Okita ..... 74/480 B
5,214,977 A * 6/1993 Nagafusa ..... 74/480 B
5,216,934 A * 6/1993 Iwasaki ..... 74/480 B
5,222,901 A * 6/1993 Burkenpas ..... 440/86
5,318,466 A * 6/1994 Nagafusa ..... 440/84
5,336,120 A * 8/1994 Maurer et al. ..... 440/84
5,352,138 A * 10/1994 Kanno ..... 440/1
6,485,340 B1 * 11/2002 Kolb et al. ..... 440/84
7,142,955 B1 * 11/2006 Kern et al. ..... 440/84
2003/0092331 A1 * 5/2003 Okuyama ..... 440/84
2006/0240720 A1 * 10/2006 Yamashita et al. ..... 440/1

FOREIGN PATENT DOCUMENTS

JP 3065414 5/2000

* cited by examiner

*Primary Examiner*—Lars A Olson
(74) *Attorney, Agent, or Firm*—Knobbe, Martens, Olson & Bear, LLP

(57) ABSTRACT

A watercraft is controllable by either a main station or a substation. A main-side remote control device is disposed in the main station. A sub-side remote control device is disposed in the substation. An outboard motor for generating propulsion force is controlled by the main-side remote control device or the sub-side remote control device. The sub-side remote control device is connected to the main-side remote control device by wiring, and the main-side remote control device is connected to the outboard motor by a network.

17 Claims, 4 Drawing Sheets

WATERCRAFT

CROSS-REFERENCE TO RELATED APPLICATIONS

This application claims priority to Japanese patent application no. 2005-294352, which was filed Oct. 7, 2005, the entirety of which is hereby incorporated by reference.

BACKGROUND OF THE INVENTION

1. Field of the Invention

The present invention relates to a watercraft in which there are provided a main station and a substation for the ship control on the hull side, and a watercraft propulsion device for generating propulsion force is electrically controlled through operation of a remote control device provided in each of these stations.

2. Description of the Related Art

It is sometimes desired to control a watercraft from multiple, spaced apart locations. Japanese patent number 3065414 describes a watercraft having an outboard motor disposed at the stern of a hull, a first control seat (main station) disposed in the midsection of the hull, and a second control seat (substation) disposed above the first control seat.

A remote control system is provided for the control of the outboard motor, which is spaced from the control seats. The remote control system includes remote controls disposed at the first and second control seats, a motor driven actuator disposed near the stern, wiring for electrically connecting the remote controls and various kinds of switches on a switch panel to the motor driven actuator, and a throttle cable and a shift cable mechanically coupling the motor driven actuator and the outboard motor.

SUMMARY OF THE INVENTION

Applicant has noted that, in a conventional system, wires of two systems are extended and connected from remote controls disposed in the first control seat and second control seat to the motor driven actuator disposed near the stem, wiring is complicated and each remote control can control only the outboard motor. No one remote control was able to control the other remote control.

Therefore, if an abnormality such as a short circuit occurs in the remote control of the substation or in a communication circuit or the like, this abnormality affects the outboard motor, thus lowering the reliability of the motor.

Accordingly in one embodiment the present invention provides a watercraft controllable by either of its controls on the main station side and the substation side, wherein wiring is simplified and one remote control device can be controlled by the other control device.

In another embodiment, the present invention provides a watercraft in which even if an abnormality occurs on the substation side, it has no ill effect on the operation of a watercraft propulsion device.

In accordance with one embodiment, the present invention provides a watercraft comprising a watercraft propulsion device supported on a hull of the watercraft. A main control station comprises a first remote control device adapted to generate a signal for controlling operation of the propulsion device. A control substation is spaced from the main control station and comprises a second remote control device adapted to generate a signal for controlling operation of the propulsion device. The second remote control device is connected to the first remote control device by a wire adapted to communicate a signal from the second remote control device. The first remote control device is connected to the propulsion device by a network.

In another embodiment, the first remote control device is connected to the propulsion device by a wire adapted to communicate a signal from the first remote control device to the propulsion device.

In yet another embodiment, the first remote control device electrically communicates with both the second remote control device and the propulsion device. In a further embodiment, the propulsion device comprises a controller.

A further embodiment additionally comprises a cut-off device adapted to terminate an electrical connection between the first and second remote control devices. In one embodiment, the cut-off device is adapted to disrupt continuity of at least one wire extending between the first and second remote control devices. In another embodiment, the cut-off device is adapted to disrupt continuity of at least a pair of electronic signal wires extending between the first and second remote control. In yet another embodiment, the cut-off device is adapted to selectively connect a terminal resistance across a pair of electronic signal wires that extend between the first remote control and the propulsion device. The terminal resistance is adapted to reduce electronic noise. In one embodiment, the terminal resistance is automatically connected upon disruption of continuity of corresponding wires between the first and second remote controls.

Another embodiment comprises a circuit configured to detect an abnormality between the first and second remote control devices. The cut-off device is actuated upon detection of an abnormality. In still another embodiment, the terminal resistance is connected upon detection of an abnormality and actuation of the cut-off device.

In still another embodiment, the cut-off device is adapted to disrupt continuity of all electronic wiring extending between the first and second remote control devices. In a still further embodiment, the cut-off device is disposed at the main control station. In yet further embodiments, the main control station comprises a first ECU and a second ECU, each of the first and second ECU communicating by wire with the second remote control device, and the cut-off device is adapted to disrupt communication between one of the first and second ECU and the second remote control device. In another embodiment, the cut-off device is adapted to disrupt communication between both the first and the second ECU and the second remote control device.

DETAILED DESCRIPTION OF PREFERRED EMBODIMENTS

With reference now to FIG. 1 through FIG. 4, a watercraft comprises an outboard motor 11, also referred to as a "watercraft propulsion device," mounted to a stern of a hull 10. The outboard motor 11 preferably can be controlled from either a first or a second control seat (main station 12 and substation 13, respectively). In the illustrated embodiment, the substation 13 is disposed at a location on the watercraft vertically higher than the main station 12.

Figure 1:
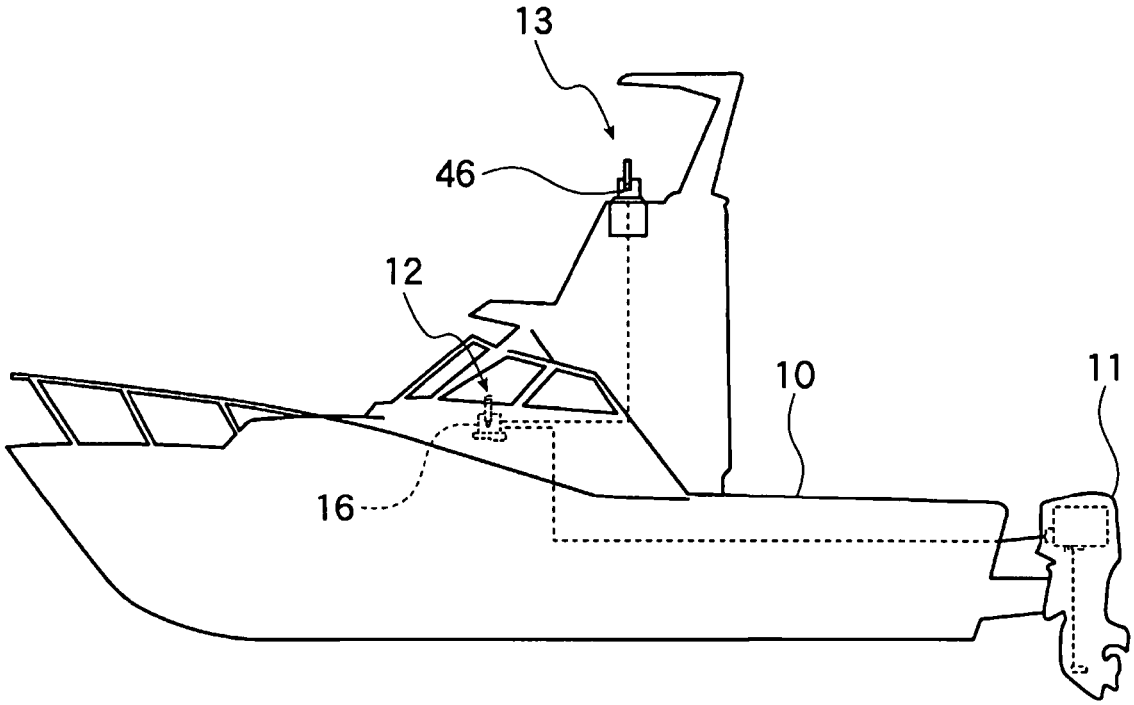
FIG. 1 is a schematic side view of a watercraft according to an embodiment of this invention.
Figure 2:
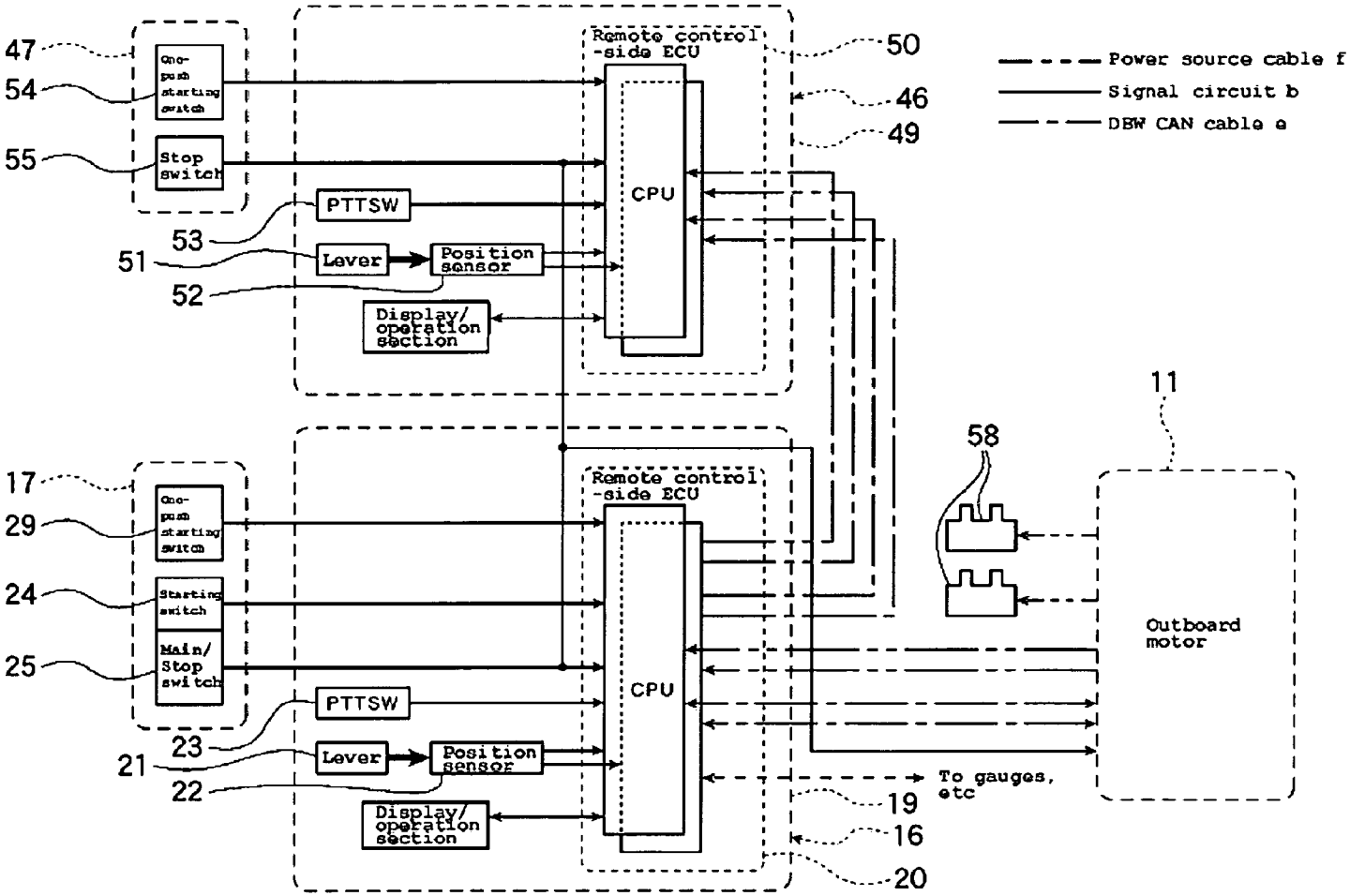
FIG. 2 is a schematic view showing a wiring arrangement of the watercraft according to the embodiment of FIG. 1.

As shown particularly in FIG. 2, the main station 12 preferably comprises a main-side remote control device 16, a key switching device 17 and a steering wheel device (omitted in the figure). Likewise, the substation 13 preferably comprises a sub-side remote control device 46, a key switching device 47 and a steering wheel device (omitted in the figure).

The main-side remote control device 16 of the main station 12, as described in FIG. 2, has a remote control-side ECU 20 built-in in a remote control body 19 and is provided with a remote control lever 21 for throttling and shifting operation. A position sensor 22 preferably detects the position of the remote control lever 21. The position sensor 22 preferably is connected to the remote control-side ECU 20 through two signal circuits b. Power Trim and Tilt (PTT) switches 23 are connected to the remote control-side ECU 20 through signal circuits b.

The key switching device 17 preferably is connected to the remote control-side ECU 20 of the main-side remote control device 16. The key switching device 17 preferably comprises a starting switch 24, a main/stop switch 25 and a one-push starting switch 29. The starting switch 24, main/stop switch 25 and one-push starting switch 29 preferably are connected to the remote control-side ECU 20 through signal circuits b.

The signal circuits b for the connection between these starting switch 24 and main/stop switch 25 and the remote control-side ECU 20 preferably are detachably connected to the sides of the key switching device 17 and main-side remote control device 16 through connectors (omitted in the figure).

The steering wheel device preferably has a steering wheel-side ECU built-in and is provided with a steering wheel for the steering, so that the position of the steering wheel is detected by the position sensor, and the position sensor is connected to the steering wheel-side ECU through a signal circuit.

Further, the steering wheel-side ECU of the steering wheel device preferably is connected to the remote control-side ECU 20 of the foregoing main-side remote control device 16 through DBW CAN cables as signal lines. Here, DBW means Drive-By-Wire and refers to a control device in which connection conventionally performed mechanically is performed electrically. CAN is an abbreviation of Controller Area Network.

Like the foregoing main station side 12, the sub-side remote control device 46 of the substation 13 preferably comprises a remote control-side ECU 50 disposed in a remote control body 49 and is provided with a position sensor 52 for detecting the position of a remote control lever 51. The position sensor 52 is connected to the remote control-side ECU 50 through two signal circuits b. Power Trim and Tilt (PTT) switches 53 are connected to the remote control-side ECU 50 through a signal circuit b.

The key switching device 47 is connected to the remote control-side ECU 50 of the sub-side remote control device 46. The key switching device 47 preferably comprises a one-push starting switch 54 and a stop switch 55 the one-push starting switch 54 and stop switch 55 preferably are connected to the remote control-side ECU 50 through signal circuits b.

The signal circuits b for the connection between these starting switch 54 and stop switch 55 and the remote control-side ECU 50 preferably are detachably provided on the sides of the key switching device 47 and the sub-side remote control device 46 through connectors (omitted in the figure).

A steering wheel device (not shown) preferably is connected to the sub-side remote control device 46 preferably in a manner like unto the main station 12-side.

As shown in FIG. 2, the remote control-side ECU 20 of the foregoing main station 12, is connected to the outboard motor 11 through a power source cable f and a DBW CAN cable e, and the outboard motor 11 is connected to a battery 58. With specific reference to FIG. 3, the outboard motor 11 and the remote control-side ECU 20 of the main station 12 preferably are connected through a connector 59 provided at the ends of the power source cable f and DBW CAN cable e.

Figure 3:
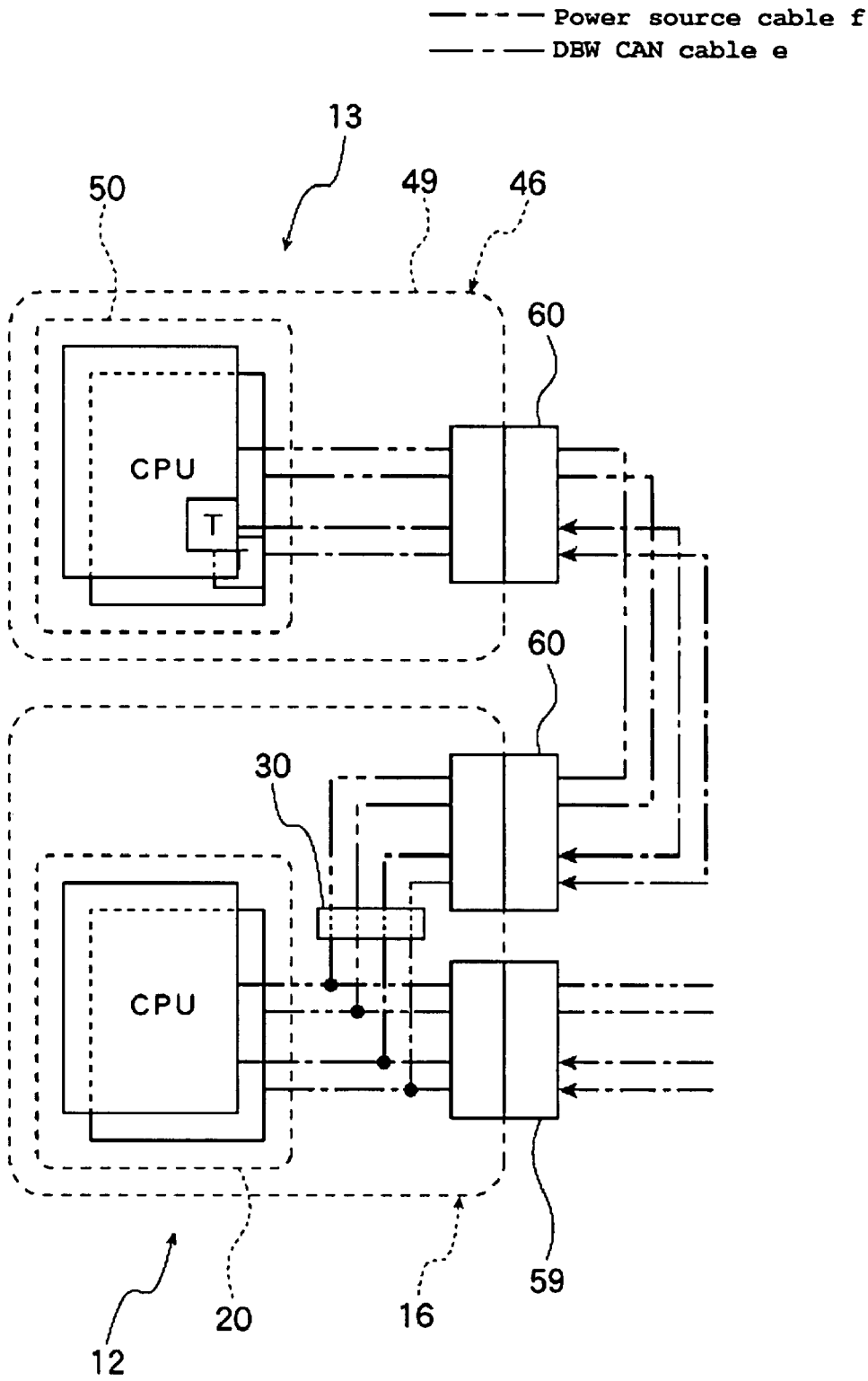
FIG. 3 is a schematic view showing the connecting condition of a main-side remote control device on the main station side and a sub-side remote control device on the substation side in the watercraft according to an embodiment.

With continued reference to FIG. 3, the remote control-side ECU 20 of the main station 12 preferably is connected to the remote control-side ECU 50 of the substation 13 through a power source cable f and a DBW CAN cable e. Connectors 60 at the ends of the power source cable f and DBW CAN cable e connect to the remote control-side ECU 20 of the main station 12 and the remote control-side ECU 50 of the substation 13.

An engine-side ECU (not shown in the figure), also referred to as a "propulsion device side ECU," preferably is built-in to the foregoing outboard motor 11. The engine-side ECU preferably is connected to a start system, an ignition system and a fuel injection system, so that the propulsion mechanism (engine) is operated by these start system, ignition system and fuel injection system for the generation of propulsion force.

Figure 4:
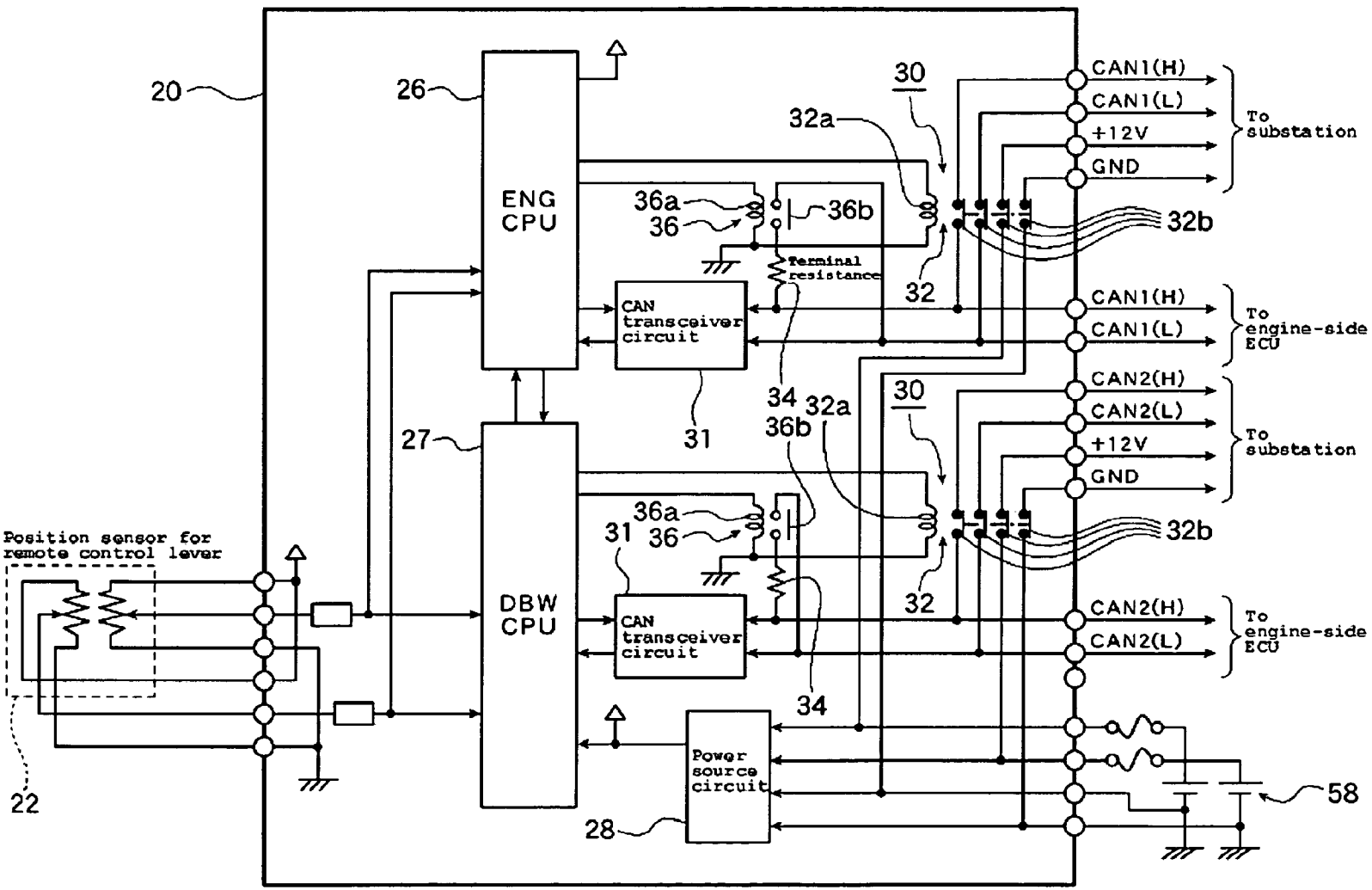
FIG. 4 is a block diagram of the main-side remote control device on the main station side in the watercraft according to an embodiment.

With specific reference next to FIG. 4, the remote control-side ECU 20 of the foregoing main station 12 has an ENG CPU 26 and a DBW CPU 27. The battery 58 is connected to the DBW CPU 27 through a power source circuit 28. The DBW CPU 27 and ENG CPU 26 are connected to the outboard motor 11 through DBW CAN cables e, which communicate with the engine-side ECU of the motor 11. The battery 58 is also connected to the engine-side ECU. The DBW CPU 27 and ENG CPU 26 are connected to the remote control-side ECU 50 of the substation 13 through DBW CAN cable e and power source cable f.

The remote control-side ECU 20 of the main station 12 preferably is provided with a cut-off device 30 adapted to detect occurrence of an abnormality in the remote control-side ECU 50 or the like of the substation 13 and to cut off the electrical connection of the remote control-side ECU 50 to the remote control-side ECU 20 of the main station 12 and to the outboard motor 11. The cut-off device 30 preferably corresponds to each of the DBW CPU 27 and ENG CPU 26 of the remote control-side ECU 20 in the main station 12.

In the block diagram of FIG. 4, a pair of cut-off devices 30 are provided, one in connection with the ENG CPU 26, and another in connection with the DBW CPU 27. In the illustrated embodiment, the cut-off devices 30 are substantially similar to one another. It is to be understood that, in other embodiments, a single cut-off device can be provided for both the ENG CPU 26 and the DBW CPU 27.

The cut-off device 30 preferably has a CAN transceiver circuit 31 for detecting an abnormality in the substation 13. A cut-off relay 32 preferably is configured to cut the connection of the substation 13 to the remote control-side ECU 50 when an abnormality is detected by the CAN transceiver circuit 31.

As shown in FIG. 4, a DBW CAN cable e from the ENG CPU 26 preferably branches, with one branch extending toward the outboard motor 11 and another branch extending toward the substation 13. The CAN transceiver circuit 31 preferably is provided between the branch point and the ENG CPU 26, and is arranged such that an abnormality detection signal is sent to the ENG CPU 26 when an abnormality in the substation 13 is detected.

Similarly, a DBW CAN cable e from the DBW CPU 27 preferably branches, with one branch extending toward the outboard motor 11 and another branch extending toward the substation 13. The CAN transceiver circuit 31 preferably is provided between the branch point and the DBW CPU 27 and is arranged such that an abnormality detection signal is sent to the DBW CPU 27 when an abnormality in the substation 13 is detected.

With continued reference to FIG. 4, on the ENG CPU 26 side, a cut-off relay 32 has a magnetization coil 32*a* and a plurality of normally-closed contacts 32*b*. Two of these normally-closed contacts 32*b* are provided along the DBW CAN cable e between the branch point and the substation 13. Two other normally-closed contacts 32*b* are provided along the power source cable f extended toward the substation 13. More specifically, the power source cable f branches off toward the substation 13 from between the battery 58 and the power source circuit 28, and the other two normally-closed contacts 32*b* are provided between the branch point and the substation 13.

The magnetization coil 32*a* preferably is connected to the ENG CPU 26 and is arranged such that it is energized when an abnormality in the substation 13 is detected by the CAN transceiver circuit 31. Upon energizing of the coil 32*a*, the four normally-closed contacts 32*b* are opened so that the connecting condition of the substation 13 to the main station 12 and outboard motor 11 is cut off. When cut off, the substation 13 can send no control signals to the outboard motor 11, and thus has no effect on the motor.

Likewise, on the DBW CPU 27 side, a normally-closed contact 32*b* of the cut-off device 30 is disposed along a DBW CAN cable e and along a power source cable f. A magnetization coil 32*a* for opening the normally-closed contact 32*b* preferably is connected to the DBW CPU 27 for selectively cutting off electrical communications along these cables.

On the ENG CPU 26 side, a terminal resistance 34 for securing the communication quality is provided across CAN 1(H) and CAN 1(L) of the DBW CAN cable e between the CAN transceiver circuit 31 and its branch point.

A normally-open contact 36*b* of the relay 36 is disposed adjacent to the terminal resistance 34 and a magnetization coil 36*a* of the relay 36 is connected to the ENG CPU 26. The magnetization coil 36*a* is magnetized upon actuation of the cut-off device 30 and the normally-open contact 36*b* is closed so that the terminal resistance 34 is connected. Such resistance 34 is adapted to suppress electronic noise so that the quality of communication between the main station 12 and the outboard motor 11 is secured.

A terminal resistance 34 and a relay 36 preferably are also provided on the DBW CPU 27 side in a manner similar to the ENG CPU 26 side.

When control of the watercraft is performed by a driver in the main station 12, if the driver operates the starting switch 24 to actuate the outboard motor 11, this signal is inputted in the remote control-side ECU 20. From the remote control-side ECU 20 a signal is communicated to the engine-side ECU through DBW CAN cables e of two systems, so that the start system, ignition system and fuel injection system or the like (omitted in the figure) are controlled and a throttle valve is opened through a throttle motor for the operation of the propulsion mechanism.

When the remote control lever 21 is operated with the outboard motor 11 in operation, a signal from the position sensor 22 is inputted in the ENG CPU 26 and DBW CPU 27 of the remote control-side ECU 20, and the signal of the position of the remote control lever 21 is sent from the ENG CPU 26 and DBW CPU 27 to the engine-side ECU. In the engine-side ECU, rotation of the throttle valve is controlled by the throttle motor based on the position of the remote control lever 21 so that a desired propulsion force is achieved by the propulsion mechanism, as well as a desired velocity of the watercraft.

In addition, the position of the remote control lever 21 is detected to determine whether the lever is at an advancing position, a neutral position or a reversing position. The shift motor is controlled by the engine-side ECU based on the signal, and the shift mechanism is actuated, if necessary, to place the outboard motor in an appropriate drive mode.

If the steering wheel is rotated in a given direction, the angle of this steering wheel rotation is detected by the position sensor and the signal is inputted in a steering-side ECU through a steering wheel-side ECU. The steering motor is controlled by this steering-side ECU and the outboard motor 11 is operated through a steering mechanism so as to run in a given direction.

Preferably, steering and other control of the outboard motor 11 can also be performed also in the substation 13 side in a manner similar to the main station 12 side.

During such watercraft control from the substation 13, if an abnormality occurs such as a short circuit of the sub-side remote control device 46 on the substation 13 side or a DBW CAN cable e and the like, the abnormality is detected by the CAN transceiver circuit 31 on the main station 12 side and inputted in the ENG CPU 26 and/or DBW CPU 27.

Once such an abnormality is detected and input, the magnetization coil 32*a* of the cut-off device 30 is energized by the ENG CPU 26 and/or DBW CPU 27, and the normally-closed contact point 32*b* is opened, so that a DBW CAN cable e and a power source cable f extending from the branch point toward the substation 13 are cut off, thus halting communication and operation of the sub-side remote control 4*b*.

As a result, even if an abnormality occurs such as a short circuit of the sub-side remote control device 46 on the substation 13 side or a DBW CAN cable e and the like, the abnormality will not influence operation of the main station 12 and outboard motor 11. Therefore, reliable watercraft control is provided by the main station 12 side.

Since the sub-side remote control device 46 is connected to the main-side remote control device 16 as discussed and the main-side remote control device is connected to the outboard motor 11 by a network, preferably including wires, the sub-side remote control device 46 can be controlled by the main-side remote control device 16. This simplifies wiring as compared with a conventional system.

Further, in the illustrated embodiment, the outboard motor 11, main station 12 and sub-station 13 are connected by DBW CAN cables e and power source cables f of two systems, and two cut-off devices 30 are provided accordingly. As such, if an abnormality occurs in one of the two systems, the connecting condition can be cut off only for the system where the abnormality occurred, because only the cut-off device 30 where the abnormality occurred is actuated. Therefore, if the other system is normal, the watercraft can be controlled in the substation 13 side through the system. In another embodiment, detection of an error or abnormality triggers cut off of the entire substation 13.

As discussed above, when the cut-off device 30 is actuated, the magnetization coil 36*a* of the relay 36 is energized for the magnetization, preferably at the same time, As such, the normally-open contact 36*b* is closed by this magnetization coil 36*a* and the terminal resistance 34 is connected. The terminal resistance 34 helps reduce noise so that the quality of communication is preserved.

Although in the foregoing embodiment, one outboard motor 11 is provided, this invention is not limited to that configuration, and embodiments employing two or more outboard motors are contemplated. In addition, the "watercraft propulsion device" of this invention is not limited to the outboard motor 11, but an inboard and outboard motor or the like may be used.

Further, although in the foregoing embodiment, the cut-off device 30 is disposed in the main-side remote control device 16, this invention is not limited to that configuration. In another embodiment, the cut off device may be disposed in the sub-side remote control device 46. In this case, detection of abnormality on the substation 13 side is also performed in the main station 12 side and the cut-off device 30 disposed in the sub-side remote control device 46 is actuated based on this detection so that the substation 13 side and the main station 12 side are cut off.

Although this disclosure has presented certain preferred embodiments and examples, it will be understood by those skilled in the art that the present inventions extend beyond the specifically disclosed embodiments to other alternative embodiments and/or uses and obvious modifications and equivalents thereof. In addition, while a number of variations have been shown and described in detail, other modifications, which are within the scope of invention, will be readily apparent to those of skill in the art based upon this disclosure. It is also contemplated that various combinations or subcombinations of the specific features and aspects of the embodiments may be made and still fall within the inventive scope. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

What is claimed is:

1. A watercraft, comprising a watercraft propulsion device supported on a hull of the watercraft, a main control station comprising a first remote control device adapted to generate a signal for controlling operation of the propulsion device, and a control substation spaced from the main control station and comprising a second remote control device adapted to generate a signal for controlling operation of the propulsion device, wherein the second remote control device is connected to the first remote control device by a wire adapted to communicate a signal from the second remote control device, and the first remote control device is connected to the propulsion device by a network, and wherein a signal from the first remote control device through the network controls the propulsion device, and the signal from the first remote control device through the wire controls the second remote control device.

2. A watercraft as in claim 1, wherein the first remote control device is connected to the propulsion device by a wire adapted to communicate a signal from the first remote control device to the propulsion device.

3. A watercraft as in claim 1, wherein the first remote control device electrically communicates with both the second remote control device and the propulsion device.

4. A watercraft as in claim 3, wherein the propulsion device comprises a controller.

5. A watercraft as in claim 1, wherein the first remote control has a first electronic control unit (ECU) and the second remote control device has a second ECU, and the wire from the second remote control device connects to the first ECU.

6. A watercraft as in claim 5, wherein the first ECU is electronically connected to the propulsion unit.

7. A watercraft, comprising a watercraft propulsion device supported on a hull of the watercraft, a main control station comprising a first remote control device adapted to generate a signal for controlling operation of the propulsion device, and a control substation spaced from the main control station and comprising a second remote control device adapted to generate a signal for controlling operation of the propulsion device, wherein the second remote control device is connected to the first remote control device by a wire adapted to communicate a signal from the second remote control device, the first remote control device is connected to the propulsion device by a network, and a cut-off device is adapted to terminate an electrical connection between the first and second remote control devices.

8. A watercraft as in claim 7, wherein the cut-off device is adapted to disrupt continuity of at least one wire extending between the first and second remote control devices.

9. A watercraft as in claim 8, wherein the cut-off device is adapted to disrupt continuity of at least a pair of electronic signal wires extending between the first and second remote control.

10. A watercraft as in claim 9, wherein the cut-off device is adapted to selectively connect a terminal resistance across a pair of electronic signal wires that extend between the first remote control and the propulsion device, the terminal resistance adapted to reduce electronic noise.

11. A watercraft as in claim 10, wherein the terminal resistance is automatically connected upon disruption of continuity of corresponding wires between the first and second remote controls.

12. A watercraft as in claim 10 additionally comprising a circuit configured to detect an abnormality between the first and second remote control devices, wherein the cut-off device is actuated upon detection of an abnormality.

13. A watercraft as in claim 12, wherein the terminal resistance is connected upon detection of an abnormality and actuation of the cut-off device.

14. A watercraft as in claim 8, wherein the cut-off device is adapted to disrupt continuity of all electronic wiring extending between the first and second remote control devices.

15. A watercraft as in claim 8, wherein the cut-off device is disposed at the main control station.

16. A watercraft as in claim 15, wherein the main control station comprises a first ECU and a second ECU, each of the first and second ECU communicating by wire with the second remote control device, and the cut-off device is adapted to disrupt communication between one of the first and second ECU and the second remote control device.

17. A watercraft as in claim 16, wherein the cut-off device is adapted to disrupt communication between both the first and the second ECU and the second remote control device.

* * * * *